US006874526B2

(12) United States Patent
Koetter

(10) Patent No.: US 6,874,526 B2
(45) Date of Patent: Apr. 5, 2005

(54) HYDRAULIC CONTROL DEVICE

(75) Inventor: Wolfgang Koetter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 31 days.

(21) Appl. No.: 10/297,215

(22) PCT Filed: Mar. 29, 2001

(86) PCT No.: PCT/DE01/01274

§ 371 (c)(1),
(2), (4) Date: Dec. 2, 2002

(87) PCT Pub. No.: WO01/92729

PCT Pub. Date: Dec. 6, 2001

(65) Prior Publication Data

US 2004/0099316 A1 May 27, 2004

(30) Foreign Application Priority Data

Jun. 2, 2000 (DE) ..... 100 27 382

(51) Int. Cl.[7] ..... F15B 13/04
(52) U.S. Cl. ..... 137/269; 91/446; 137/596
(58) Field of Search ..... 91/446; 137/269, 137/596

(56) References Cited

U.S. PATENT DOCUMENTS 4,176,521 A 12/1979 Budzich
4,519,419 A 5/1985 Petro

FOREIGN PATENT DOCUMENTS

| | | |
|---|---|---|
| DE | 19 44 822 A | 3/1970 |
| DE | 36 03 811 A | 8/1987 |
| DE | 36 34 728 A | 4/1988 |
| EP | 0 877 169 A | 11/1998 |

*Primary Examiner*—Gerald A. Michalsky
(74) *Attorney, Agent, or Firm*—Michael J. Striker

(57) ABSTRACT

A hydraulic control device (10, 90) for load pressure-independent control of a double-acting motor, in which by replacing the pressure balance regulator throttle slide valve element (68, 93) but using the same housing (13), the control device can be converted from a directional-control valve (11) with a primary individual pressure balance regulator (12) for load pressure-independent control to a directional-control valve (91) with a secondary individual pressure balance regulator (92) for an oil flow distribution in the event of undersupply. To this end, in a second longitudinal bore (41) containing the control pressure opening (68, 93), the housing (13) has three axially spaced infeeds of control pressure openings (51, 52, 53), which can be activated differently through interchangeable installation of a sealing plug (66) and a stopper (67) and, together with the respective throttle slide valve element, constitute a primary pressure balance regulator (12) or a secondary pressure balance regulator (92). The control device (10, 90) can be inexpensively produced for different functions using the same housing (13).

17 Claims, 4 Drawing Sheets

HYDRAULIC CONTROL DEVICE

BACKGROUND OF THE INVENTION

The invention is based on a hydraulic control device for load pressure-Independent control of a double-acting motor.

DE 19 44 822 A1 has disclosed a hydraulic control device for load pressure-independent control of a double-acting motor in which a pressure balance regulator is connected upstream of the metering orifice embodied in the control slide valve element. In this directional-control valve, with the pressure balance regulator connected upstream of the metering orifice, its throttle slide valve element is acted on in the closing direction by the pressure upstream of the metering orifice in the control slide valve element and is acted on in the opening direction by the pressure downstream of the metering orifice, i.e. by the load pressure plus the force of a spring. The pressure balance regulator consequently keeps the pressure difference constant by means of the metering throttle in the directional-control valve even when the load pressure varies and consequently also maintains the associated through flow so that the working speed set in the directional-control valve is kept constant. A directional-control valve of this kind is also referred to as an LS (load sensing) valve with a primary individual pressure balance regulator, which permits a load pressure-independent control. It is disadvantageous that this control device does not permit a supply-dependent oil flow distribution. If directional-control valves of this kind are used to simultaneously control several motors operating in parallel, then first the motor with the lowest load pressure is supplied with a pressure fluid flow while the rest of the volume flow is conveyed to the other motors. The ratio of the distribution of the volume flows, which in this case does not remain constant, changes with the load pressure. Particularly in the event of an undersupply, this can result in the fact that the least loaded motor continues to function while a highly loaded, parallel-actuated motor comes to a standstill, which is undesirable in many applications. Such an LS directional-control valve is relatively complex and expensive; its housing is especially equipped for this design and its components such as the housing, flange patterns, and slide valve are only suited for this LS directional-control valve with a primary individual pressure balance regulator.

Furthermore, such a hydraulic control device for load pressure-compensated control of a double-acting motor is known from DE 36 34 728 A1, wherein two such directional-control valves for a parallel actuation of the associated motors are supplied with pressure fluid by a single variable displacement pump, whose regulator is acted on by the respective maximal load pressure of the two motors by means of a control line containing a series of shuttle valves. In this case, in each directional-control valve, the pressure balance regulator used for load pressure compensation is followed by a metering orifice in the control slide valve element; the pressure balance regulator also precedes the piston sections of the control slide valve element that are used for directional control. The throttle slide valve element in the subsequent pressure balance regulator is acted on in the opening direction by the pressure downstream of the metering orifice and is acted on in the closing direction by the respective highest load pressure and the regulating pressure difference due to the regulating spring. Such directional-control valves with a secondary individual pressure balance regulator, which can also be referred to as LC (load compensating) directional-control valves, permit the disadvantages mentioned at the beginning to be avoided. In this instance, when two or more directional-control valves are operated in parallel and there is not enough pump oil flow, i.e. when there is an undersupply, less oil flows uniformly via all of the metering orifices. The pressure differences in the respective metering orifices are therefore reduced and less oil flows to the motors. The oil flow through the directional-control valves decreases in proportion to the predetermined reference values. In principle, therefore, it involves a valve device for dividing the pump flow into individual partial flows that flow to each motor; even when the motors are placed under different loads, the distribution ratio remains constant and consequently, the motions are maintained without causing the highest loaded motor to come to a standstill. An LC directional-control valve of this kind is also relatively complex and expensive; its housing is especially equipped for this design and therefore has a special housing, flange pattern, and slide valve that are only suited for a directional-control valve with a secondary individual pressure balance regulator.

Furthermore, EP 0 877 169 A2 has disclosed a hydraulic control device for load pressure-independent control of a double-acting motor, which operates with such LC directional-control valves for oil flow distribution in the event of an undersupply and to this end, has secondary individual pressure balance regulators. This directional-control valve also has an additional check valve disposed between the control slide valve element and the pressure balance regulator, which permits higher safety requirements to be met. This directional-control valve also has a housing that is only suitable for an LC type and cannot be used in an LS directional-control valve with a primary individual pressure balance regulator.

SUMMARY OF THE INVENTION

The hydraulic control device according to the invention for load pressure-independent control of a double-acting motor, has the advantage over the prior art that it permits valves using both the LS and the LC technology to be produced with the same housing in that only a different throttle slide valve element is installed for the pressure balance regulator. Consequently, an LS directional-control valve with a primary individual pressure balance regulator for load pressure-independent control can be produced with the same housing as an LC directional-control valve with a secondary individual pressure balance regulator for oil flow distribution in the event of an undersupply. The flange patterns on the housing and the control slide valve element in the housing remain the same. With the proposed conduit arrangement, the directional-control valves with different functions are merely assembly variants, which differ only with regard to the differing throttle slide valve elements of the pressure balance regulator. The special arrangement of the control pressure openings in the longitudinal bore containing the throttle slide valve element, in connection with the interchangeably disposed obturating plugs of the longitudinal bore, permits the respective connection of the control circuit and the throttle slide valve element to be achieved. In this connection, inlet elements and end elements of the valve blocks remain the same for both connection variants.

The other embodiments permit the control line connections for the different valve types to be produced in a particularly suitable manner. Further embodiments are also advantageous and permit all of the functions of both valves to be integrated compactly into the same housing. It is favorable if the control pressure openings in the longitudinal bore for the throttle slide valve element are arranged.

BRIEF DESCRIPTION OF THE DRAWINGS

Two exemplary embodiments of the invention are shown in the drawings and will be explained in detail in the subsequent description.

DESCRIPTION OF THE PREFERRED EMBODIMENTS

Figure 1:
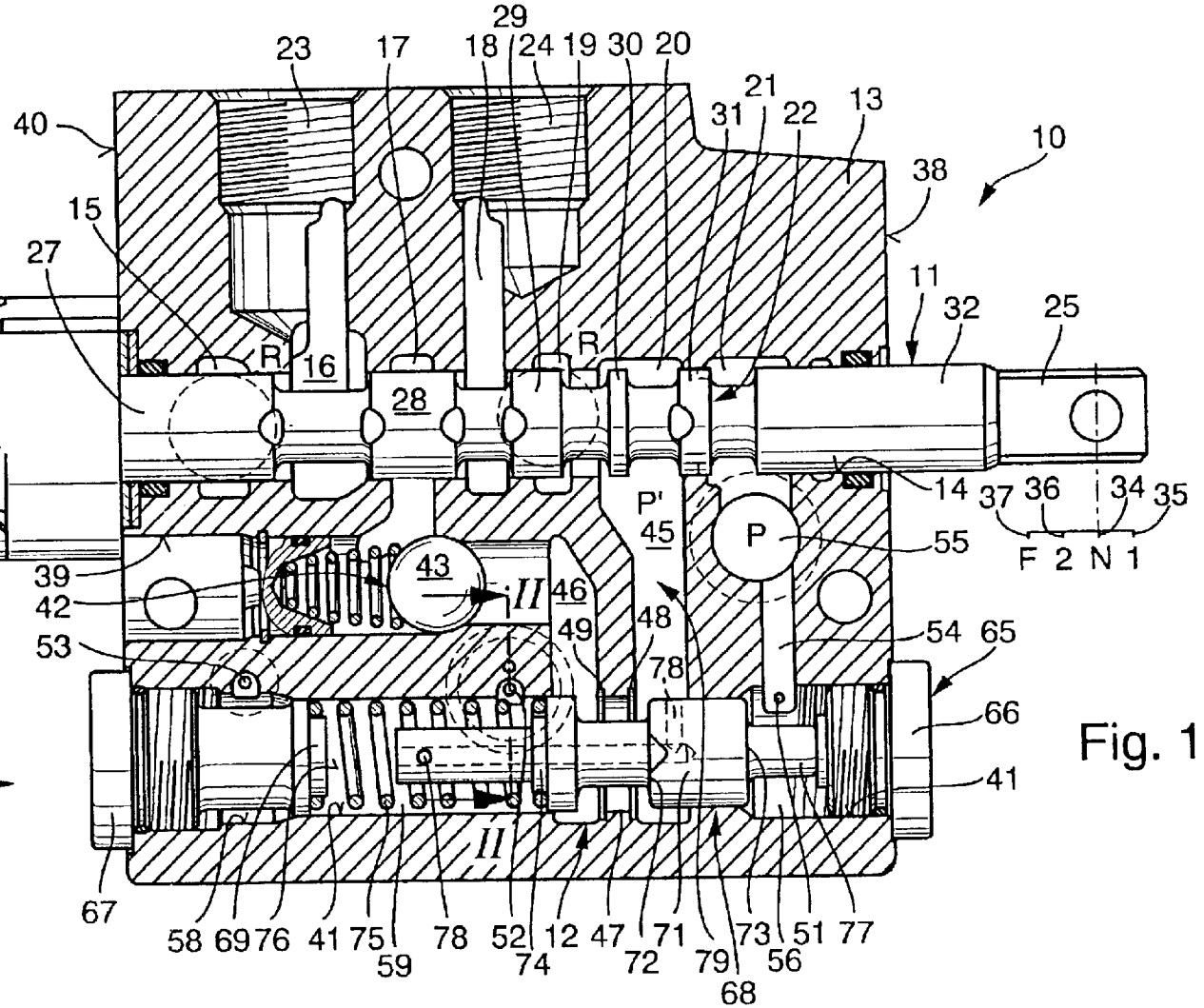
FIG. 1 shows a simplified longitudinal section through a hydraulic control device with an LS directional-control valve and a primary individual pressure balance regulator.

FIG. 1 shows a longitudinal section through a hydraulic control device 10 using LS technology for load pressure-independent control of a double-acting motor. In the control device 10, the actual directional-control valve 11 in a load-sensing (LS) embodiment and the associated pressure balance regulator 12 in an embodiment as a primary individual pressure balance regulator are disposed in a common housing 13.

The housing 13 has a continuous longitudinal bore 14 extending between the two end faces and containing annular widenings that form a total of seven chambers 15 to 21, of which the five chambers 15 to 19 next to one another are used for the directional control of the pressure fluid flow, while the two chambers 20, 21 on the outside are associated with a metering orifice 22, which is used to control the speed of the motor. Of the five chambers 15 to 19 next to one another, the middle chamber serves as an inlet chamber 17, while the chambers disposed next to it constitute a first motor chamber 16 and a second motor chamber 18, which communicate with a respective motor connection 23 and 24. Next to each motor chamber 16, 18, there is a return chamber 15, 19, which communicate in a manner not shown in detail with a return connection in the housing 13. Of the two metering orifice chambers 20, 21, the first metering orifice chamber 20 disposed next to the second return chamber 19 is used as an outlet-side metering orifice chamber and the other is used as an inlet-side, second metering orifice chamber 21.

A control slide valve element 25 is guided in a sealed, sliding manner in the longitudinal bore 14. The control slide valve element 25 is divided into six piston sections 27 to 32 by means of annular grooves. The three piston sections 27, 28, 29 disposed next to one another are equipped with control edges and are used for directional control. An adjoining fourth piston section 30, which is disposed in the outlet-side metering orifice chamber 20 in the depicted neutral position of the control slide valve element 25, is primarily used to relieve the pressure in a control circuit. The adjoining fifth piston section 31 is part of the metering orifice 22 and, with its control edges, respectively determines the magnitude of the volume flow to the motor and therefore its speed when the control slide valve element is moved into the two working positions. The outer sixth piston section 32 protrudes out from the longitudinal bore 14, thus allowing it to be engaged by an actuating device that is not shown in detail. At its opposite end, the control slide valve element 25 protrudes with the first piston section 27 into a double-acting return device 33, whose design is intrinsically known, which centers the control slide valve element in its neutral position 34 from which it can be moved into two working positions 35 and 36. The control slide valve element 25 also has a fourth switched position 37, which is embodied as a free-floating position.

As is also depicted in FIG. 1, below the first longitudinal bore 14, the housing 13 contains a bore 39 embodied in the form of a blind hole and underneath it, also contains a second longitudinal bore 41, both of which extend parallel to the first longitudinal bore 14. The blind bore 39 contains a check valve 42 with a ball-shaped closing member 43. By contrast, the second multiply stepped longitudinal bore 41 extends between the first end face 38 of the housing 13 on the operational side and the second end face 40 of the housing 13 oriented toward the return device 33 and contains the primary individual pressure balance regulator 12. In order to permit this, the outlet-side metering orifice chamber 20 has an extension 45, which extends essentially perpendicular to the control slide valve element 25 and intersects with the second longitudinal bore 41. In addition to this extension 45, the housing 13 also contains a circulation chamber 46, which likewise extends perpendicular to the control slide valve element 25 and whose end oriented toward the slide valve feeds into the blind bore 38, while the end of the circulation chamber 46 oriented away from the control slide valve element 25 penetrates into the second longitudinal bore 41. In this manner, a wall of the housing 13 extending between the extension 45 and the circulation chamber 46 constitutes an annular rib 47, the two sides of which have a first control edge 48 in the extension 45 and a second control edge 49 in the circulation chamber 46, both of which edges are stationary in relation to the housing.

As also shown in FIG. 1, a first (51), second (52), and third control opening (53) feed into the second longitudinal bore 41 at three points spaced axially apart from one another. The first control pressure opening 51 is constituted by a conduit 54 that starts from an inlet conduit 55 and feeds into a widened section 56 of the second longitudinal bore 41. The inlet conduit 55 extends between the two flange surfaces of the housing 13 and communicates with the inlet-side second metering orifice chamber 21. The conduit 54 with its control pressure opening 51 is disposed in a region of the housing 13 situated between the extension 45 and the operational end face 38. The distance of the first control pressure opening 51 from the first end face 38 is selected to be essentially the same as the distance between the third control pressure opening 53 and the second end face associated with it. The third control pressure opening 53 is part of a control line 57 labeled Y', which can convey a maximal load pressure of a control circuit into the second longitudinal bore 41. The third control pressure opening 53 is correspondingly disposed in a second widened section 58, which corresponds to the first widened section 56. In the vicinity of the second longitudinal bore 41 between the two widened sections 56, 58, there is an inner section 59, in which the second control pressure opening 52 feeds into the second longitudinal bore 41. The second control pressure opening 52 is disposed spaced slightly apart from the circulation chamber 46. The second control pressure opening 52 is provided for tapping the maximal load pressure of the connected motor. As shown in detail in FIG. 1 in connection with a detail view in FIG. 2, this pressure signal from the second control pressure opening 52 in the directional-control valve 11 is compared in a shuttle valve 61 to another pressure signal from a second directional-control valve 62, and the selected maximal load pressure signal is transmitted via a control pressure conduit 63. The shuttle valve 61 and the control pressure conduit 63 thereby constitute parts of an intrinsically known control pressure circuit 64 in which, by means of shuttle valves connected in series, the maximal load pressure is selected in an intrinsically known fashion and is used for a load-sensing control.

In the housing 13, the second continuous longitudinal bore 41 is closed in relation to the outside by obturating plugs 65, of which there are two types, namely embodied as sealing plugs 66 and stoppers 67. In the housing 13 provided for the LS directional-control valve 11, the sealing plug 66 is screwed into the first widened section 56 and simultaneously serves as a stop for a throttle slide valve element 68 of the primary individual pressure balance regulator 12. The stopper 67 screwed into the second widened section 58 protrudes with a collar 69 into the inner section 59 of the second longitudinal bore 41 in a sealed fashion so that it overlaps and therefore hydraulically obturates the third control pressure opening 53. The sealing plugs 66 and stoppers 57, as well as the second longitudinal bore 41, are embodied so that the two obturating plugs 65 can also each be disposed in the opposite position in the second longitudinal bore 41.

As is also shown in FIG. 1, the throttle slide valve element 68 is guided so that it can slide between the two obturating plugs in the second longitudinal bore 41. On a first piston section, 71, the throttle slide valve element 68 has a control edge 72, which cooperates with the first control edge 48 of the annular rib 47 affixed to the housing. Oriented toward the sealing plug 66, the first piston section 71 has a measuring surface 73 against which the throttle slide valve element 68 is acted on by the pressure in the inlet conduit 55 via the control pressure opening 51. On its opposite end surface 74, the throttle slide valve element 68 is acted on by a compression spring 75, which is disposed in a spring chamber 76 and holds the throttle slide valve element 68 in a starting position, with its stop pin 77 resting against the sealing plug 66. In addition, bores 78 extending inside the throttle slide valve element 68 cause the spring chamber 76 to be acted on in the opening direction by the pressure in the extension 45, i.e. with the pressure downstream of the metering orifice 22.

The outlet side metering orifice chamber 20 is thus connected via a transverse conduit 79 to the inlet chamber 17; the pressure balance regulator 12 and the check valve 42 are connected one after the other in this transverse conduit 17. The throttle slide valve element 68 is thus disposed downstream of the metering orifice 22, but is acted on by the inlet pressure against its measuring surface 73 so that it can assume the function of a primary individual pressure balance regulator in an LS directional-control valve 11.

Figure 3:
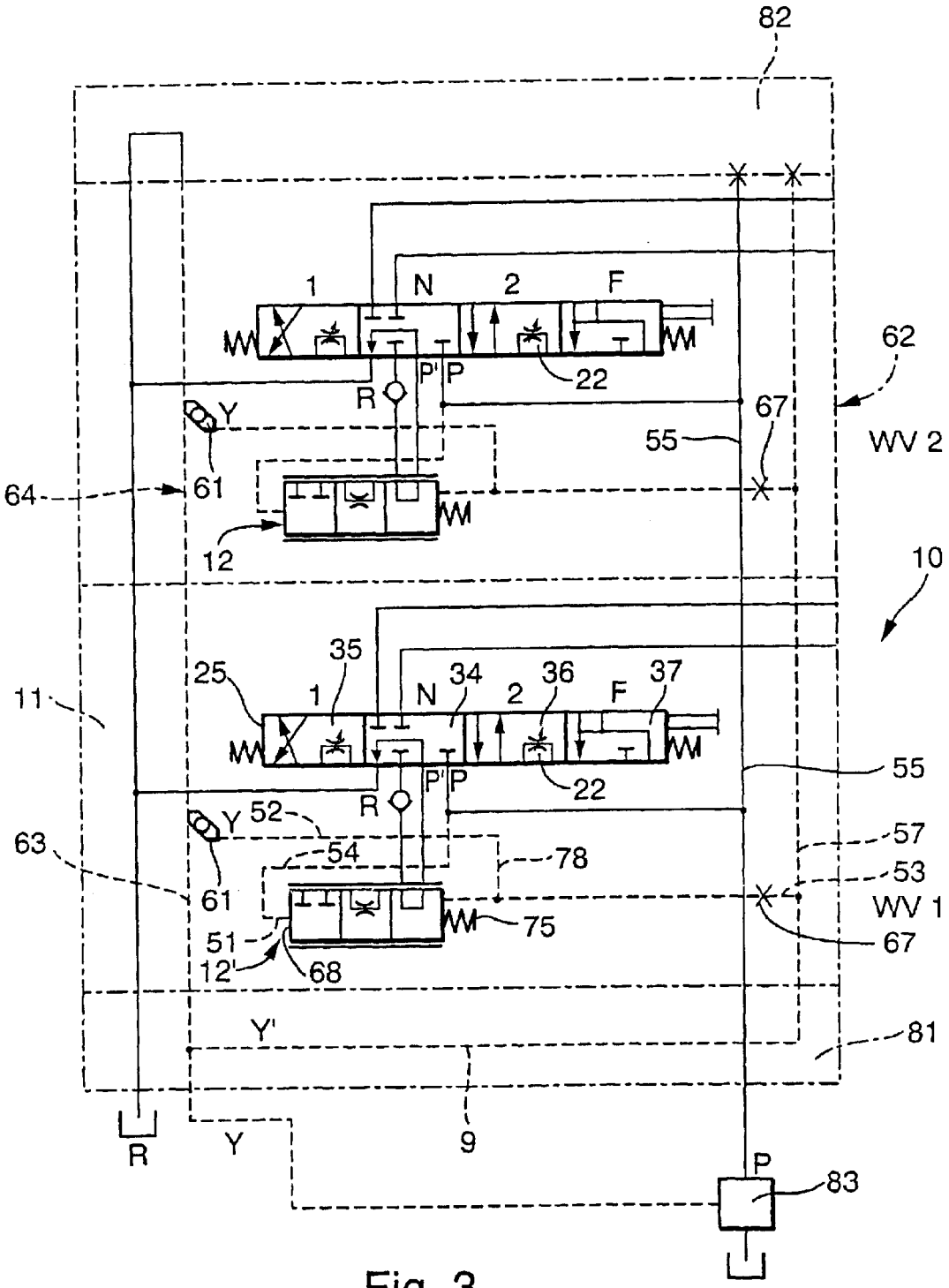
FIG. 3 shows a schematic depiction of a control block for two double-acting motors with two control devices using LS technology according to FIG. 1.

FIG. 3 schematically depicts a control block in which next to the first control device 10, there is a similar second control device 62 and they are flange-mounted to each other so that at least two double-acting motors can be actuated in parallel. The control devices 11, 62 are disposed between a connecting plate 81 and an end plate 82 and are connected in parallel to the continuous inlet conduit 55. The inlet conduit 55 is supplied with pressure fluid via a pressure fluid supply unit 83; the maximal load pressure is returned via the control circuit 64.

To that end, the shuttle valves 61 in the two control devices 10 constitute a valve series, which is used to select and transmit the respective maximum load pressure and is used to produce a pressure relief of the control circuit 64. In FIG. 3, functionally identical components have been labeled the same as in FIG. 1 so that the connection of the control pressure openings 51, 52, and 53 as well as the function of the stopper 67 is evident.

The operation of the control device 10 will be explained below; it is assumed that the fundamental function of such LS directional-control valves is known in and of itself. In the control devices 10, 62 that are identical to each other and are connected in parallel, the respective primary individual pressure balance regulator 12 is connected after the metering orifice 22 and is also disposed upstream of the directional control edges in the directional-control valve 11. In this connection, the throttle slide valve element 68 is designed, disposed, and acted or by the control pressures so that the function of a primary individual pressure balance regulator is achieved. Thus the pressure from the inlet conduit 55 and therefore upstream of the metering orifice 22 acts in the closing direction on the measuring surface 73 of the throttle slide valve element 68 by means of the conduit 54 and the first control pressure opening 51. The pressure downstream of the metering orifice 22 in the extension 45 is conveyed via the bores 78 in the throttle slide valve element 68 into the spring chamber 76, where it acts in the opening direction on the throttle slide valve element 68 along with the spring 75. The shuttle valve 61 is used to execute the pressure comparison between the pressure Y1 in the spring chamber 76 and the pressure Y2 from the adjacent control device 62. The highest load pressure selected in the control pressure circuit 64 is conveyed on the one hand to the pump 83 and on the other hand, into the control line 57. This control line 57, however, is shut off by the stopper 67 in each control device 10, 62; the respective collar 69 produces the seal in relation to the spring chamber 76. On the opposite side, the sealing plug 66 functions as a stop for the throttle slide valve element 68.

In the neutral position 34, which is shown in detail in FIGS. 1 and 3, the control pressure circuit 64 connected to the second control pressure opening 52 is pressure relieved into the second return chamber 19 via the bores 78 in the throttle slide valve element 68, the extension 45, the outlet-side metering orifice chamber 20, and the open control edge on the fourth piston section 30. As a result, the pump 83 is also controlled to a low starting pressure. Such a pressure relief of the control pressure circuit 64 is particularly simple in design and permits the embodiment of the control slide valve element 25 as a solid slide valve element, which therefore has no internal connecting bores. The same type of pressure relief can also be achieved if the control slide valve element 25 assumes its fourth free-floating switched position 37.

If the control device 10 is actuated by itself and is thereby moved into one of the working positions 35 or 36, then a load pressure-independent control of the connected motor can be achieved. The volume flow arriving from the pressure fluid supply unit 83 via the inlet conduit 55 then flows via the open metering orifice 22 and the subsequent primary pressure balance regulator and the check valve 43 into the inlet chamber 17 and on into the motor or from the motor back into the return. Before the metering orifice 22 opens here, the fourth piston section 30 closes the connection to the second return chamber 19 so that no oil loss occurs in the direction of the return. The pressure upstream of the metering orifice 22 also acts on the measuring surface 73 of the throttle slide valve element 68 and moves it in the direction of a closed position counter to the force of the spring 75; the control edge 72 on the first piston section 71 cooperates with the first control edge 48 affixed to the housing. The pressure that builds up in the extension 45 when the metering throttle 22 is open can also build up in the spring chamber 76 by means of the bores 78 and can load the throttle slide valve element 68 in the opening direction. When a volume flow is flowing to the motor via the transverse conduit 79, the pressure balance regulator 12 consequently keeps the pressure drop via the metering orifice 22 constant in an intrinsically known fashion so that the speed of the motor is controlled in proportion to the displacement of the control slide valve element 25 and thereby independent of load pressure fluctuations. The check valve 42 in the transverse conduit 79 thereby also assures a reliable maintenance of the load even in the event of possible malfunctions.

However, if both control devices 10, 62 are actuated at the same time, then the primary individual pressure balance regulators 12 acted on by the inlet pressure prevent a reciprocal influence in the event of different consumer pressures during parallel operation as long as a sufficiently large volume flow is supplied by the pressure fluid supply unit 83. However, if there is an undersupply in the volume flow, then this can result in the intrinsically known disadvantages; the motor under the least load remains functional while a motor under a high pressure comes to a standstill, which is undesirable in many applications.

Figure 4:
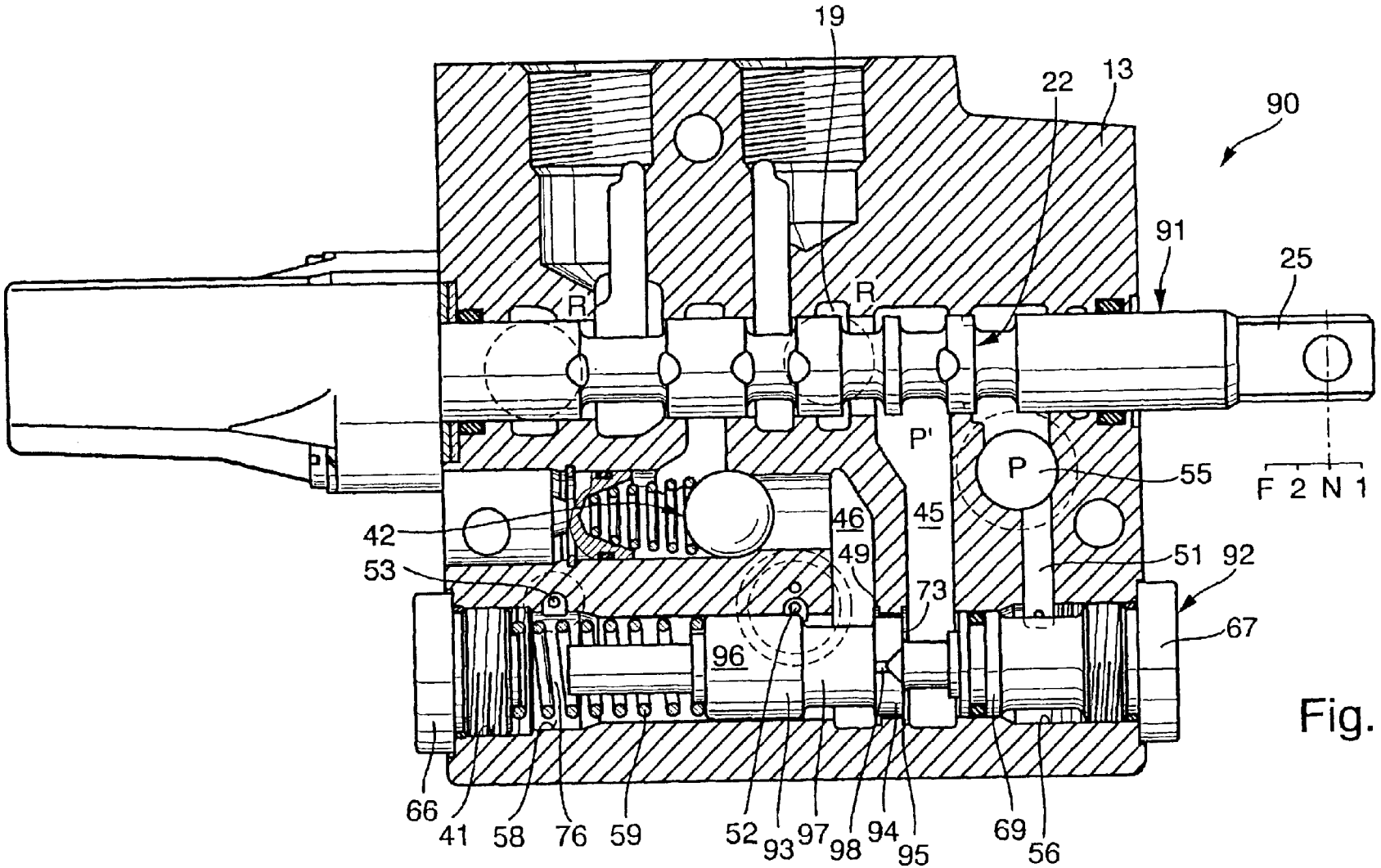
FIG. 4 shows a simplified longitudinal section through a hydraulic control device with an LC directional-control valve and a combined secondary individual pressure balance regulator.

As a second embodiment of the invention, FIG. 4 now shows a third control device 90, which is embodied as an LC directional-control valve 91 for an oil flow distribution in the event of an undersupply and to this end, operates with a secondary individual pressure balance regulator 92. This third control device 90 differs from the first control device 10 according to FIG. 1 as follows; components that are the same have been labeled with the same reference numerals.

Figure 2:
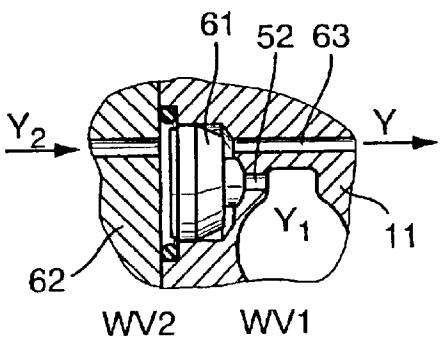
FIG. 2 shows a detail of a shuttle valve from a control circuit in a section along line II—II in FIG. 1.

It is crucial here that for this third control device 90, with the exception of another throttle slide valve element 93, the same parts are used as in the first control device 10, in particular the housing 13 with its control slide valve element 25, the check valve 42, and the shuttle valve 61 according to FIG. 2 and also the two obturating plugs 65. However, with the third control device 90 in the housing 13, the obturating plugs 65 are installed in the opposite positions, so the stopper 67 is disposed in the first widened section 56 of the second longitudinal bore 41 while the sealing plug 66 is disposed in the second widened section 58. The stopper 67, which likewise serves as a stop for the throttle slide valve element 93, now hydraulically blocks the first control pressure opening 51. At the other end, the sealing plug 66 permits the third control pressure opening 53 to communicate with the spring chamber 76.

The second throttle slide valve element 93 for the secondary individual pressure balance regulator 92 now has a control edge 95, which is disposed on a first piston section 94 and cooperates with the second control edge 49 affixed to the housing. In addition, the measuring surface 73 is disposed on the same side of the piston section 94 as the control edge 95 and is consequently acted on by the pressure in the extension 45. A second piston section 96 guides the throttle slide valve element 93 in the vicinity of the inner section 59 of the second longitudinal bore 41 in a sliding fashion and hydraulically shuts off the spring chamber 76 connected to the third control pressure opening 53 from the second control pressure opening 52. This second control pressure opening 52 continuously communicates with the circulation chamber 46 via an annular groove 97 in the throttle slide valve element 93. In addition, a notch 98 is disposed in the first piston section 94 of the throttle slide valve element 93 and when the throttle slide valve element 93 is disposed in its starting position, this notch 98 continuously pressure relieves the circulation chamber 46 into the extension 45 and therefore on into the second return chamber 19.

Figure 5:
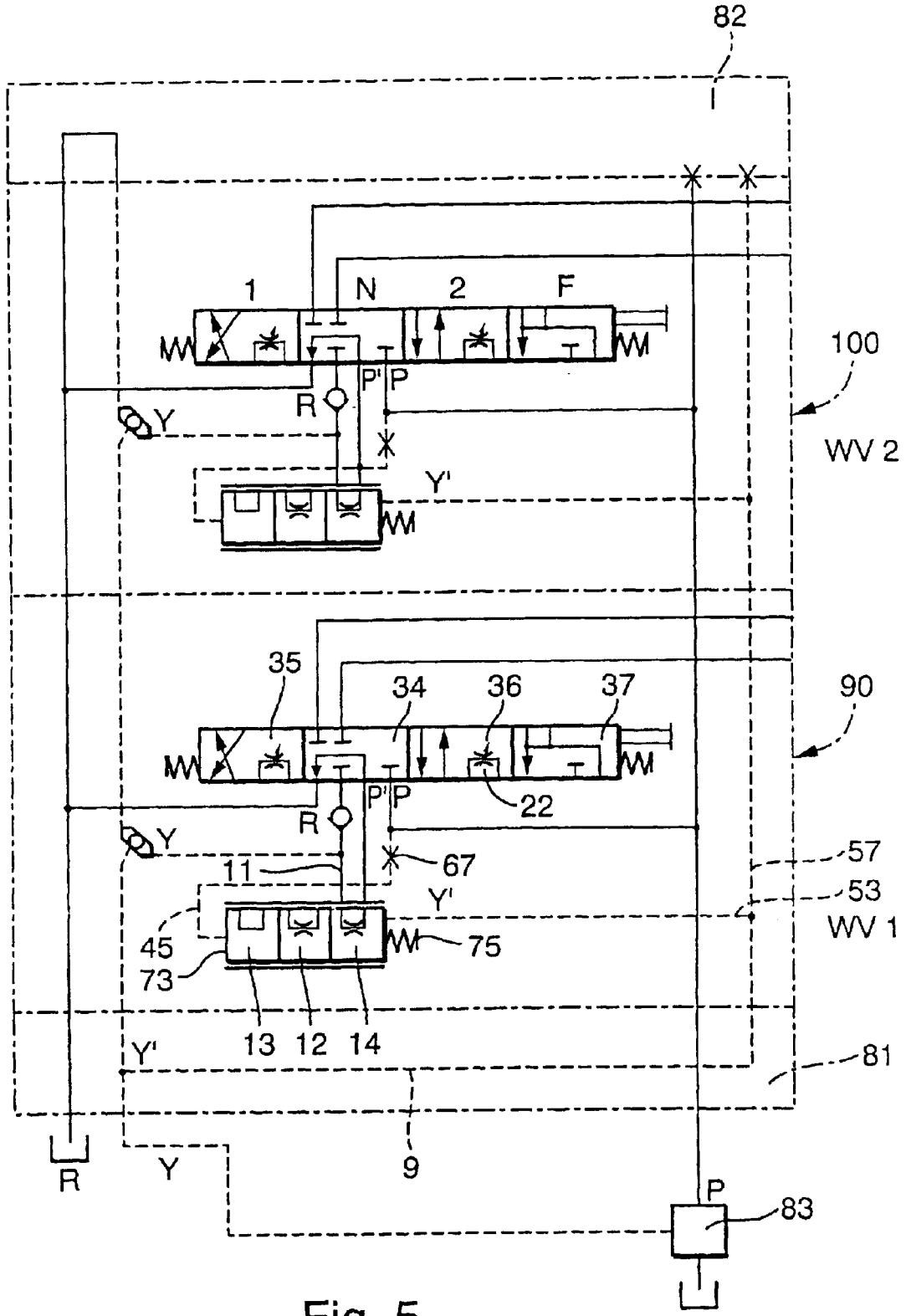
FIG. 5 shows a schematic depiction of a control block for two double-acting motors with two control devices using LC technology according to FIG. 4.

In a manner that corresponds to FIG. 3, FIG. 5 schematically depicts a control block in which, next to the third control device 90, there is a similar second control device 100, and the two are flange-mounted to each other so that at least two double-acting motors can be actuated in parallel. The connecting plate 81, the end plate 82, and the pressure fluid supply unit 83 are the same as in FIG. 3. As can be inferred from FIG. 4 in connection with FIG. 5, in order to produce an LC directional-control valve with a secondary individual pressure balance regulator, the positions of the control pressure taps 51, 52, 53 in the housing 13 have not been changed and only the throttle slide valve element 93 itself has been changed. In the secondary pressure balance regulator 92, the pressure of the extension 45 and therefore also the pressure downstream of the metering orifice 22 now act on the measuring surface 73. In addition, the respective highest load pressure Y' prevails in the spring chamber 76. This tapping of the load pressure signal takes place from the circulation chamber 46 via which the annular groove 97 in the throttle slide valve element 93, the second control pressure opening 52, and the shuttle valve 61, from which the load pressure signal can also travel into the control line 57 and therefore to the third control pressure opening 53.

In the neutral position of the third control device 90, the second control pressure opening 52 is pressure relieved into the second return chamber 19 via the notch 98 and the control slide valve element 25. The stopper 67 shuts off the unneeded control pressure from the metering orifice 22 by its collar 69 blocking the connection to the extension 45.

The operation of the control device 90 will be explained below; it is assumed that the fundamental function of such an LC directional-control valve is known in and of itself. If the third control device 90 is actuated by itself and is moved into one of the working positions 35 or 36, then a load pressure-independent control of the connected motor can be achieved. The volume flow arriving from the pressure fluid supply unit 83 via the inlet conduit 55 then flows via the open metering orifice 22 and the subsequent secondary pressure balance regulator 92 and the check valve 42 into the inlet chamber 17 and on into the motor or from the motor back into the return. The secondary pressure balance regulator 92 thus keeps the pressure drop via the metering orifice 22 constant so that the speed of the motor is controlled in proportion to the movement of the control slide valve element 25.

If the two control devices 90 and 100 are actuated in parallel, then a supply-dependent oil flow distribution occurs, which is also referred to as a so-called social behavior. The respective highest load pressure occurring in one of the motors is thereby connected to the spring side 76 of all of the secondary pressure balance regulators 92 of the control devices 90 and 100. As a result, the throttle slide valve elements 93 of the two pressure balance regulators 92 are adjusted so that the same pressure always prevails against their end face 73 oriented toward the respective metering orifice 22, even if the motors are under different loads, so that in relation to each other, the metering orifices 22 always have constant pressure fluid quantities flowing through them. In principle, the apparatus is a valve arrangement for dividing the pump flow into individual partial flows that flow to each motor; even when the motors are placed under different loads, the distribution ratio remains constant and the desired speed is consequently maintained. If a sufficient pump oil flow does not flow in this parallel actuation of the two control devices 90, 100 so that there is an undersupply, then correspondingly less oil flows uniformly via all of the metering orifices 22. This is assured by the subsequent secondary pressure balance regulator 92, which always regulates the pressure to the highest load pressure plus the regulating pressure difference. In the event of an undersupply, the pump pressure and the pressure differences in the metering orifices 22 therefore decrease and less oil flows to the motors. The oil flow through the control devices 90, 100 decreases in relation to the predetermined reference values. The pressure difference at the metering orifices drops until the sum of the partial oil flows corresponds to the pump oil flow.

The proposed conduit arrangements in the housing 13, in connection with a different throttle slide valve element, can consequently represent different directional-control valves using LS technology or LC technology, which function on the one hand with a primary individual pressure balance regulator and on the other hand, with a secondary individual pressure balance regulator and which can be achieved by means of assembly variants based on the same housing.

It is naturally possible to modify the embodiment forms shown without going beyond the scope of the concept of the invention.

What is claimed is:

1. A hydraulic control device for load pressure-independent control of a double-acting motor with a directional-control valve, whose housing has a longitudinal bore that contains a control slide valve element, which has piston sections for controlling the direction and speed of the motor and has a transverse conduit that is connected upstream of the piston sections used for directional control and contains a two-way pressure balance regulator whose pressure balance regulator throttle slide valve element can be acted on by a spring counter to a differential force between two control pressures, wherein the throttle slide valve element is disposed in a second longitudinal bore that can be obturated in relation to the outside by at least one obturating plug at the end, characterized in that by replacing the pressure balance regulator throttle slide valve element (68, 93) but using the same housing (13), the control device (10, 90) can be converted from a directional-control valve (11) with a primary individual pressure balance regulator (12) for load pressure-independent control to a directional-control valve (91) with a secondary individual pressure balance regulator (92) for an oil flow distribution in the event of undersupply.

2. The hydraulic control device according to claim 1, characterized in that the second longitudinal bore (41), which is disposed in the housing (13) and contains the throttle slide valve element (68, 93), is embodied as continuous and can be obturated at the ends by two obturating plugs (65), one of which is embodied as a sealing plug (66) and the other of which is embodied as a stopper (67).

3. The hydraulic control device according to claim 2, characterized in that the stopper (67) and the sealing plug (66) can be fastened in reciprocally interchangeable positions in the second longitudinal bore (41).

4. The hydraulic control device according to claim 2, characterized in that control pressure openings (51, 52, 53) are disposed at three points that are distributed axially in the second longitudinal bore (41), of which the two outer control pressure openings (51, 53) can be hydraulically obturated by the stopper (67).

5. The hydraulic control device according to claims 4, characterized in that an inner section (59) of the second longitudinal bore (41) is fed by a second control pressure opening (52), which communicates with a shuttle valve (81) of a control pressure circuit (84), wherein in particular, the second control pressure opening (52) is disposed adjacent to a circulation chamber (48).

6. The hydraulic control device according to claim 5, characterized in that between the second control pressure opening (52) and a housing end (40) at the end face, a third control pressure opening (53) feeds into the second longitudinal bore (41).

7. The hydraulic control device according to claim 5, characterized in that in order to embody the secondary individual pressure balance regulator (92), the second longitudinal bore (41) contains the throttle slide valve element (93), whose measuring surface (73) oriented away from a spring chamber (76) can be acted on by a pressure in a downstream metering orifice chamber (20) and can be acted on in the spring chamber (76) by the load pressure via a third control pressure opening (53) and by the force of the spring (75), and that a control edge (95) of the throttle slide valve element (93) cooperates with a control edge (49) on an annular rib (47), which control edge is stationary in relation to the housing and is disposed in a circulation chamber (46).

8. The hydraulic control device according to claim 7, characterized in that the second longitudinal bore (41) containing the throttle slide valve element (93) is closed at the end face (38) on the operational side by the stopper (87), which closes the first control pressure opening (51) off from an outlet-side metering orifice chamber (20), while the third control pressure opening (53) is connected to the spring chamber (76), which is closed by the sealing plug (68) in the other end face (40), and that the throttle slide valve element (93) closes the second control pressure opening (52) off from the third control pressure opening (53) and always maintains a connection to the circulation chamber (46) via an annular groove (97) in the throttle slide valve element (93).

9. The hydraulic control device according to claim 4, characterized in that the first and third control pressure opening (51, 53) each feed into a widened section (56, 58) of the second longitudinal bore (41) and their respective distances from the associated end faces (38, 40) of the housing (13) are essentially the same.

10. The hydraulic control device according to claim 4, characterized in that the wall, which is disposed in the housing (13) between a circulation chamber (46) and an outlet-side metering orifice chamber (20), constitutes an annular rib (47) in the second longitudinal bore (41), which rib constitutes housing control edges (48, 49) for the pressure balance regulator slide valves (68, 93) on both sides.

11. The hydraulic control device according to claims 1, characterized in that the piston section (31), which is disposed on the control slide valve element (25) and serves as a metering orifice (22) for the speed control, is connected via the transverse conduit (79) oriented toward the housing to the separately situated piston section (28) for the directional control on the control slide valve element (25), wherein the metering orifice chambers (20, 21) associated with the metering orifice (22) in the first longitudinal bore (14) are disposed laterally next to the five working chambers (15 to 19) for the directional control in the housing (13).

12. The hydraulic control device according to claim 11, characterized in that the downstream metering orifice chamber (20) has an extension (45), which extends approximately perpendicular to the piston slide valve (25) and essentially parallel to a circulation chamber (46), and that the extension (45) and the circulation chamber (46) penetrate into the second longitudinal bore (41) while the upstream metering orifice chamber (21) communicates with an inlet conduit (55) and, via a conduit (54), extends into the second longitudinal bore (41) to form a first control pressure opening (51).

13. The hydraulic control device according to claim 1, characterized in that between the two parallel longitudinal bores (14, 41) for the control slide valve element (25) and the throttle slide valve element (68, 93), the housing has a third bore (39), all three of the bores are disposed in one plane, and the third, center bore (39) contains a check valve (42).

14. The hydraulic control device according to claim 13, characterized in that the central bore (39) is embodied in the form of a blind hole and its inner end extends into a circulation chamber (46), which extends essentially perpendicular to the longitudinal axis of the control slide valve element (25) and penetrates into the second longitudinal bore (41).

15. The hydraulic control device according to claim 1, characterized in that the control slide valve element (25) is embodied as a solid slide valve, whose interior does not contain any connecting lines for the working or control pressure fluid.

16. The hydraulic control device according to claim 1, characterized in that in order to embody a primary individual pressure balance regulator (12), the second longitudinal bore (41) contains a throttle slide valve element (68), whose measuring surface (73) oriented away from a spring chamber (76), via a first control pressure opening (51), can be acted on by the pressure in the inlet (55) end which, in the spring chamber (78), can be acted on by the pressure downstream of a metering orifice (22) via bores (76) in the throttle slide valve element (68) as well me by the force of a spring (75), and that a control edge (72) of the throttle slide valve element (68) cooperates with a control edge (48) on an annular rib (47), which control edge is stationary in relation to the housing and is disposed in an outlet-side metering orifice chamber (20).

17. The hydraulic control device according to claim 16, characterized in that the second longitudinal bore (41) containing the throttle slide valve element (68) is closed by a sealing plug (65) at the end face (38) on the operational side and is closed at the other end face (40) by a stopper (87), which simultaneously closes a third control pressure opening (53) off from a second control pressure opening (52).

* * * * *